United States Patent [19]

Fremont

[11] 4,412,888

[45] Nov. 1, 1983

[54] WOOD PULP FIBER PROCESS AND RESULTANT PRODUCTS

[75] Inventor: Henry A. Fremont, Wyoming, Ohio

[73] Assignee: Champion International Corporation, Stamford, Conn.

[21] Appl. No.: 338,009

[22] Filed: Jan. 8, 1982

Related U.S. Application Data

[63] Continuation of Ser. No. 145,981, May 2, 1980, abandoned.

[51] Int. Cl.[3] ..... D21C 9/00

[52] U.S. Cl. ..... 162/54; 162/207

[58] Field of Search ..... 162/54, 207

[56] References Cited

U.S. PATENT DOCUMENTS 1,859,891 5/1932 Richter ..... 162/54

3,987,691 10/1976 Lee ..... 162/16

FOREIGN PATENT DOCUMENTS 166044 7/1921 United Kingdom .

OTHER PUBLICATIONS

*Chemical Abstracts,* 1941 23–Cellulose & Paper Col. 4949, 4950.

ABIPC, vol. 46, No. 1, (7/75) #332.

ABIPC, vol. 42, No. 3, (1972) #2345.

*Primary Examiner*—William F. Smith

*Attorney, Agent, or Firm*—Evelyn M. Sommer; John H. Mulholland; William W. Jones

[57] ABSTRACT

The present invention relates to a novel cellulosic wood pulp fiber having lower specific volume for a given surface area than conventionally prepared wood pulp fibers, to products made therefrom, and to the process of making such fiber comprising hydrating cellulosic wood pulp fiber to a freeness of at least about 650 CSF and lower, freezing the fibers while in an aqueous slurry containing at least 40% water to a fiber temperature of at least −5° C. or below, and thawing the pulp fibers to a temperature at which they will flow.

4 Claims, No Drawings

WOOD PULP FIBER PROCESS AND RESULTANT PRODUCTS

This is a continuation of application Ser. No. 145,981 filed May 2, 1980, abandoned.

BACKGROUND OF THE INVENTION

A variety of procedures are utilized to obtain fibers from wood pulps, which fibers are used to make a number of different paper, paperboard, and other wood products. Depending upon the use to be made of the wood products, a variety of additives are added thereto for purposes of improving the opacity, brightness, strength, bulk, and other like properties in the products. With increased costs of additive materials for such purposes as well as increased costs in terms of recovery of the fibers, efforts have been made to increase desired properties in the final products while decreasing costs.

More specifically, with reference to paper making, for example, a variety of materials, such as aluminum and titanium oxides are added to increase the opacity and brightness of papers made from wood pulp fibers. These are costly additives, but presently necessary to obtain paper with adequate opacity and brightness. In addition, a variety of other additives and treatments have been attempted to increase the strength and bulk of the wood pulp fibers in order to obtain more square feet of paper per ton of fiber. This is an important consideration since it permits lighter weight paper which has significance to those who publish newspapers, magazines, and other materials that are sent through the mails.

Efforts to overcome the problems of costly additives and treatments have included a variety of processing techniques including freezing and freeze-drying, but these, heretofore, have themselves required equipment that was costly to purchase and/or operate or the need for chemicals to be present during such treatment which are detrimental in subsequent operations.

SUMMARY OF THE INVENTION

An improved process has now been found which results in new and novel wood pulp fibers which can be formed into papers or other wood pulp fiber products having an increased bulk; require less drying time and also, in the case of paper, an increased opacity and brightness without the need for chemical additives.

Briefly stated, the present invention comprises the process of making cellulosic wood pulp fibers having a lower specific volume for a given surface area than conventionally prepared wood pulp fibers comprising hydrating wood pulp fiber to a freeness of at least about 650 CSF and lower, freezing the fibers while in an aqueous slurry containing at least 40% water to a fiber temperature of at least −5° C. or below, and thawing the pulp fibers to a temperature at which they will flow.

The invention also comprises cellulosic wood pulp fibers made according to the process described above which have a specific surface equal to and a specific volume less than ½ of fibers hydrated, as in the case of the instant process, but not frozen and thawed in accordance with the present invention.

DETAILED DESCRIPTION

The instant process is applicable to treatment of wood pulp fibers obtained from soft woods or hard woods, slush and dried pulp, bleached and unbleached Kraft pulp, bleached and unbleached sulfite pulp, and mixtures thereof.

The initial processing applied to the wood pulp in order to obtain the fibers is that conventionally carried out in the treatment of wood pulp, namely, the wood pulp is digested, passed through a pulp chest, washed, bleached, and passed through a bleached pulp chest. The conditions and parameters of all such steps and the equipment used are those conventionally used and known to those skilled in this art and form no part of the instant invention.

Fibers leaving the bleach pulp chest are then passed into any conventional beater, such as those presently used in making pulp, where the wood pulp fiber is beaten in water without the need for any chemicals that react with the wood pulp fibers to a freeness of at least 650 CSF as measured by the standard Canadian Standard Freeness Method. While the CSF can be as low as 0, such beating is preferably carried out to give a freeness of at least about 350 CSF since this degree of hydration gives a more suitable fiber.

The material as it leaves the beater normally contains only 3 to 4% solids in the form of fiber. While further processing can take place at such solids level, it is preferred to thicken the beaten, or hydrated, wood pulp fiber mass to a solids level of 30 to 40% solids. Thickeners employed for this purpose can be of the usual apparatus conventionally employed for concentrating wood solids. While a solids content higher than 60% can be used, it is not preferred to have a solids content much above 60% since, for the purposes of the present invention, less than optimum physical properties of the fiber and products made therefrom will be obtained. It is preferred to have the slurry at the highest possible solids content for reasons of economics; the lower the water, the less thereof there is to freeze.

In conjunction with the hydration step, it is essential that the fibers be frozen to a fiber temperature of at least −5° C. or below, preferably to −5° C. to −12° C. while in the form of a slurry as noted above. The time period required to lower the temperature to −5° C. or below, the time at such temperature, and time of thawing can vary widely and have no measurable effect on the fiber qualities, so long as the proper freezing temperature is reached. Any method for effecting the freezing can be carried out, such as by the use of a cold room, passing the slurry over freezing plates, the use of liquid nitrogen or liquid carbon dioxide, using Freons (such as Freon 12 or 114), cold liquids such as toluene, evaporative cooling (using vacuum to remove the water), and the like. Of these, the use of Freons is preferred for freezing fibers and evaporative cooling for web or sheet freezing, since the mechanical methods of cooling are too expensive and time-consuming.

After the pulp fibers have been frozen to a temperature below −5° C., they are then permitted to rise to or brought to a temperature at which they will flow prior to further treatment. Such thawing temperature is not critical so long as the fibers are flowable. Ambient temperature for example, being suitable. The time at which the fibers remain frozen is not critical, the novel fibers claimed herein being obtained even if the fibers reach the temperature of −5° C. for a matter of a few minutes.

The thawed fibers can then be processed in conventional manners to make any of the products that can be made from fibers. With respect to paper making operations, the fiber is formed into a slush pulp and fed to a Fourdrinier machine. There is no need for the pulp to be immediately processed to obtain papers having the unique results hereinafter described. The pulp can be stored for future processing by being dried; the novel effects of the fibers are not destroyed by such drying. In short, having been processed in accordance with the instant invention; namely, being hydrated, frozen, and thawed as described above, the fibers maintain their unique properties upon subsequent storage so long as they are not rebeaten or otherwise excessively mechanically worked prior to being formed into end products.

The novel fibers of the present invention, because of their morphology and increased surface hydrophobicity provide for a more uniform web formation and more porous, smooth and lightweight web. In addition, the changed morphology provides increased fiber retention in the web during web formation.

It has also uniquely been found that, in addition to treatment of the wood pulp fibers prior to being formed into webs, such as paper, the same novel effects can be obtained if the wood pulp fibers are formed into a web in any conventional manner, and then prior to being dried and while the paper still contains at least 40% water, the paper is frozen to a fiber temperature of at least −5° C. or below, followed by drying of the paper in any conventional manner. It is only necessary that the wood pulp fibers have been hydrated to a freeness of from about 0 to 650 CSF before being formed into the web.

It has been found that cellulosic wood pulp fibers made in accordance with the process described above have a specific surface equal to, and a specific volume less than one-half that of fibers made from identical wood pulp and hydrated in the same manner but not frozen and thawed as in the instant process.

Also important, web products such as paper and paperboard products made from the fibers exhibit an increase in bulk resulting in the ability to obtain more square feet per ton of paper and, consequently, much lighter weight paper. With respect to web products, moreover, unexpectedly and surprisingly large increases have been noted in the opacity and brightness of the webs made with wood pulp fibers treated as disclosed above. This permits in some instances elimination of, and in others, the use of much smaller levels of the known opacifying and brightness agents.

More importantly, it has been found that the increase in the opacifying and brightness properties are obtained even if the conventional amounts of opacifying and brightening agents such as $TiO_2$, $Al_2O_3$, $Z_nO$, and the like, are added in making the paper. The strength of the webs can be increased by adding conventional strength improvers in their usual amounts; materials such as starch and polymers such as epichlorohydrin-modified polyamides and compositions of epichlorohydrin with high molecular weight polyalkylene polyamines. In short, enhanced optical properties are built into the fibers. It has also been noted that webs made from fibers processed in accordance with the present invention have better dimensional stability, smoothness, and improved retention as compared to papers made from fibers from the same wood pulp but which has not been processed in accordance with the present invention.

The properties of the fiber are such that web products such as paper sheets made therefrom have a number of improved properties. The paper sheets are first more porous and, consequently, drain faster and require substantially less heating to dry. In addition, this porosity permits more rapid "get-away" of water during coating of the paper. Further, the paper sheets are smoother, hence resulting in superior coated and uncoated surfaces. Moreover, and most significantly, the bulk density, surface properties, and optical property enchancements persist even though the paper sheets are calendered and/or supercalendered.

The invention will be described in connection with the following examples in which proportions are by weight unless expressly stated to the contrary.

The examples are given to illustrate the best modes for carrying out the present invention, but are not to be construed as restricting the scope thereof.

EXAMPLE 1

Several runs were made to compare the properties of sheets made from frozen fiber with similar sheets prepared from regular fiber at the same consistency. In these tests, pine pulp alone was used.

Table I(A) shows properties of sheets prepared from pulp at several freeness levels. It was found that the high freeness pulps (Samples 2 and 4) developed many fiber clumps during freezing and thawing which did not redisperse on shaking. The other pulps dispersed well and gave sheets having good formation.

Caliper of the sheets made from frozen pulp was 75–100% greater than those made from the original pulp. Opacity was 10–18 units greater for sheets made from frozen pulp; a greater increase was observed at the lower freeness values. Mullen burst of sheets prepared from frozen pulp averaged about one-half that found for sheets made from the original pulp. Tear strength of sheets made from frozen pulp averaged about double that of sheets made from the original pulp.

Table I(B) shows that frozen and thawed pulp gives sheets having more desirable optical properties than sheets prepared from a pulp having the freeness of the frozen and thawed pulp. This was an important point, since it shows that freezing and thawing does more than simply reconstitute a less beaten pulp.

The sheets listed in Table I(B) were prepared under as closely similar conditions as possible in order to provide a good comparison. The optical properties of the sheet prepared from frozen and thawed pulp (initially 316 CSF, finally 550 CSF) are superior by a wide margin to the sheets made from 316 CSF pulp and by a smaller margin to the sheets made from 550 CSF pulp. The caliper difference between the sheet made from frozen and thawed pulp and the sheet made from 550 CSF pulp are less clear. The Mullen value of the sheet made from the frozen and thawed pulp was close to that of the sheet made from ordinary 550 CSF pulp.

Table I(C) shows properties of a group of sheets prepared from 450 CSF pine (before freezing), frozen as a block containing 32% solids and thawed. After redispersion, sheets were formed and pressed wet to approximately 40% solids content. Sheets were prepared containing 25%, 50%, and 75% frozen pulp, the remainder being the original pulp.

Sheets prepared from 100% frozen pulp were only 10% thicker than ones prepared from unfrozen pulp. This difference from the sheets described in Table I(A) may result from freezing at a relatively high solids content as well as the wet pressing. Corresponding to the relatively small increase in sheet thickness, the opacity increase of the sheets prepared from frozen fiber was only 7 points, and the loss in Mullen was only one-third. A 4 point increase in sheet brightness paralleled the opacity increase. All of the sheet properties changed in proportion to the amount of frozen fiber used in preparing the sheets.

TABLE I(A)

PROPERTIES OF SHEETS MADE FROM FROZEN AND THAWED PINE PULP

| Sample | Treatment | Freeness CSF, ml | Sheet Weight lbs/3300 ft$^2$ | Caliper | Opacity | Mullen | Elmendorf Tear |
|---|---|---|---|---|---|---|---|
| 1 | None | 730 | 35.9 | 11 | 77 | 6 | — |
| 2 | Frozen | 780 | 35.9 | — | 77 | — | — |
| 3 | None | 630 | 32.8 | 4 | 64 | 24 | 50 |
| 4 | Frozen | 750 | 34.5 | 8 | 74 | 12 | 118 |
| 5 | None | 420 | 34.4 | 4 | 63 | 35 | 43 |
| 6 | Frozen | 690 | 34.7 | 7 | 75 | 15 | 103 |
| 7 | None | 250 | 35.1 | 4 | 66 | 26 | 35 |
| 8 | Frozen | 630 | 35.2 | 7 | 77 | 17 | 84 |
| 9 | None | 100 | 34.9 | 4 | 61 | 29 | 37 |
| 10 | Frozen | 540 | 35.9 | 7 | 79 | 16 | 66 |

a. In these early tests, the % water in the wet web was not measured. It is estimated that it was 85–95%.
b. Pine pulp (1.5% consistency) frozen for 45 hours, 0° F.

TABLE I(B)

PROPERTIES OF SHEETS PREPARED FROM FROZEN AND THAWED PINE PULP

| Sample | Treatment | Freeness CSF, ml | Sheeted at % Solids | Sheet wt. lbs/3300 ft$^2$ | Caliper | Opacity | Brightness | Mullen |
|---|---|---|---|---|---|---|---|---|
| 10-2 | None | 316 | 36.5 | 29.6 | 3.2 | 54 | 73 | 32 |
| 10-2A | None | 316 | 35.9 | 35.9 | 3.6 | 57 | 71 | 42 |
| 10-4 | None | 550 | 36.4 | 35.1 | 4.5 | 65 | 76 | 29 |
| 10-4A | None | 550 | 39.8 | 30.4 | 3.8 | 62 | 75 | 28 |
| 10-5 | Frozen[a] | 316 ↓ 550 | 43.3 | 33.1 | 4.1 | 68 | 77 | 26 |

[a]Frozen at 1.5% consistency

TABLE I(C)

PROPERTIES OF SHEETS PREPARED FROM BLENDS OF FROZEN AND THAWED PINE PULP WITH UNFROZEN PINE PULP

| Sample | Treatment | Sheeted at % Solids | Sheet wt. lbs/3300 ft$^2$ | Caliper | Opacity | Brightness | Mullen |
|---|---|---|---|---|---|---|---|
| 1-1 | None | 42 | 32.7 | 3.3 | 59 | 74 | 30 |
| 1-2 | 25% Frozen | 38 | 32.0 | 3.5 | 62 | 74.5 | 27 |
| 1-3 | 50% Frozen | 43 | 32.7 | 3.65 | 63 | 77 | 29 |
| 1-4 | 75% Frozen | 40 | 31.6 | 3.4 | 65 | 76 | 24 |
| 1-5 | 100% Frozen | 48 | 32.7 | 3.6 | 66 | 78 | 21 |

a. 450 CSF Pine Pulp was frozen for 16 hours, 0° F., as a block containing 31.8% solids. Allowed to thaw and shook 3 hours with water.

EXAMPLE 2

The specific surface and the specific volume were determined by the permeability method on a sample of 320 CSF bleached Southern pine (1.5% consistency) and on a sample of the same pulp which was frozen (24 hours at 0° F.) and thawed at room temperature. The frozen and thawed sample was shaken mechanically for one-half hour before testing. In order to obtain strictly comparable results, the unfrozen sample was similarly shaken.

The data given in Table II were collected in this experiment.

TABLE II(A)

PERMEABILITY OF FROZEN AND THAWED PULP

| Sample | Treatment | Pad Thickness, cm | Flow Rate cc/min | Δ P g/cm$^2$ | Pad Density, g/cc |
|---|---|---|---|---|---|
| 1 | Frozen | 1.6 | 3.2 | 12.7 | 0.115 |
| | | 1.5 | 3.3 | 13.5 | .123 |
| | | 1.4 | 3.2 | 14.9 | .132 |
| | | 1.3 | 3.1 | 16.9 | .142 |
| | | 1.2 | 2.9 | 18.6 | .153 |
| | | 1.2 | 2.8 | 18.8 | .153 |
| 2 | None | 3.0 | 5.4 | 21.1 | 0.075 |
| | | 2.8 | 4.9 | 27.6 | .080 |
| | | 2.6 | 4.4 | 32.1 | .086 |
| | | 2.4 | 4.0 | 36.4 | .093 |
| | | 2.3 | 3.8 | 38.7 | .097 |
| | | 2.2 | 3.4 | 43.7 | .102 |

From these data, the specific volume and specific surface of the two pulps was calculated. The results are given in Table II(B).

TABLE II(B)

| Ref. | Treatment | Specific Surface, cm$^2$/g | Specific Volume, cm$^3$/g |
|---|---|---|---|
| 1 | Frozen | 46,000 | 1.8 |
| 2 | None | 46,000 | 5.1 |

The decrease in specific volume due to freezing and thawing is striking. The constant value found for specific surface of the two pulps was unexpected.

Casey (Pulp and Paper, p. 619–623) cites several published values for specific surface and specific volume. In all cases, specific volume and specific surface increase as freeness decreases. Since freeness of the frozen and thawed pulp was about 550, its specific surface and specific volume was expected to be less than the original pulp. None of the specific volumes cited by Casey are as low as 1.8 cc/g.

Frozen pulp formed a pad of significantly higher consistency (12–15%) than the pad of unfrozen pulp (8–10%). In addition, the pressure drop across the pad of pulp that had been frozen was about one-half that across the pad of unfrozen pulp. These data indicate that dewatering a wet web of a frozen and thawed pulp should be much easier than dewatering a normal paper web.

EXAMPLE 3

Samples, each 100 ml, of bleached Southern pine pulp (1.5% consistency) at three CSF values (180, 450, and 700) were frozen at 0° F. and allowed to thaw. The pulp was then placed carefully on an 80-mesh screen, 5" diameter. Filtration was allowed to continue until no more filtrate passed through the screen (about 5 minutes). The volume of the filtrate was measured and evaporated in an oven at 110° C. The dry solids were weighed. Data collected in the experiment are shown in Table III.

Filtrate from the frozen pulps was clear; filtrate from unfrozen pulps was cloudy. During heating, solids separated from the filtrate that had not been frozen, but not from the frozen fluid.

The relatively constant amount (g/ml) of solids found in the filtrate at different freeness levels was unexpected.

TABLE III

EFFECT OF FREEZING[a] AND THAWING ON SOLIDS CONTENT IN PULP FILTRATE[b]

| Sample | Treatment | Initial CSF, ml | Filtrate Volume ml | Filtrate Solids g | Filtrate Solids g/ml | Filtrate Solids From Pulp[c] g/ml |
|---|---|---|---|---|---|---|
| 1 | Frozen | 180 | 34 | .0103 | .00030 | .00010 |
| 2 | None | 180 | 41 | .0194 | .00047 | .00027 |
| 3 | Frozen | 450 | 45 | .0123 | .00027 | .00007 |
| 4 | None | 450 | 53 | .0239 | .00045 | .00025 |
| 5 | Frozen | 700 | 57 | .0183 | .00032 | .00012 |
| 6 | None | 700 | 64 | .0286 | .00045 | .00025 |

[a]Frozen as 1.5% solids pulp (100 ml) at 0° F. for 24 hours. Allowed to thaw at room temperature.
[b]Filtered on an 80-mesh screen until no more filtrate was obtained (3–5 minutes).
[c]Filtrate solids minus the solids in the water used. Cambridge City Water contained 200 p.p.m. on the date of this work. The calculations assume that none of the water solids was retained by the pulp.

EXAMPLE IV

Several test runs were done to determine the properties of sheets made from pulp frozen in the presence of titanium dioxide, aluminum oxide, and starch. In these experiments, a dispersion was prepared by agitation of the pigment with water in a Waring Blender. The dispersion was added to the pulp and the mixture was blended using a spatula. Starch was cooked and blended with the pulp similarly.

Freezing and thawing dispersions of titanium dioxide and aluminum oxide (Hydral) caused the solid phase to settle rapidly. A frozen and thawed starch solution showed increased opacity. This behavior, as well as the effects of freezing on pulp, might affect the sheet properties.

A. Pulp Frozen With Titanium Oxide

Table IV(A) shows properties of sheets prepared from pulp frozen in the presence of titanium dioxide. The % ash, the % solids in the wet sheet, and sheet weight were varied in these tests, and these changes prohibit some comparisons. In spite of this, it appears that the effect on opacity of freezing and titanium oxide are additive. As expected, increasing the percentage of titanium dioxide increased opacity. With one exception, sheets prepared from frozen pulp were thicker than comparable sheets made from unfrozen pulp. The four final rows in Table IV(A) indicate that Mullen strength of sheets was independent of the content of frozen and thawed fiber; this result disagrees with data given in Table I(C).

Work reported in Table III indicated that retention of pulp fines was improved significantly as a result of freezing and thawing.

B. Pulp Frozen With Aluminum Oxide

Table IV(B) shows properties of sheets prepared from pulp frozen in the presence of aluminum oxide. For convenience, the control sheets listed in Table IV(A) are given in Table IV(B) also.

Alumina was used in the form of Hydral 710 (10% aqueous dispersion) and a product identified as C-31. C-31 is a coarser product and it was milled in a colloid mill for 20 minutes to give a thick creamy dispersion containing 60% solids.

The data show that Hydral 710 was effective as an opacifier, but C-31 was not. Sheets containing each product showed the anticipated increase in opacity and thickness, and decrease in Mullen associated with freezing and thawing.

C. Pulp Frozen With Starch

Table IV(C) shows properties of sheets prepared from pulp frozen in the presence of approximately 10% its weight of cooked starch. In connection with this experiment, duplicate control sheets were prepared and these are presented also in Table IV(C).

Properties of the duplicate sheets agree reasonably well; deviation is larger than expected only for the caliper of sheet 1 and its duplicate.

The sheet prepared from frozen and thawed pulp plus starch showed the expected increase in thickness and opacity. In the presence of starch, the improvement in brightness due to freezing was minimal.

The burst strength of the sheet prepared from frozen pulp plus starch was the same as the corresponding sheet involving no freezing. The presence of the starch with the pulp resulted in a higher Mullen when freezing was done and a slightly reduced Mullen when no freezing was done. The latter effect is surprising since use of starch as a wet-end additive is reported to increase burst strength.

TABLE IV(A)

PROPERTIES OF SHEETS PREPARED FROM FROZEN AND THAWED PINE PULP[a] PULP BLENDED WITH $TiO_2$[b]

| Sample | Treatment | % Ash | Sheeted at % Solids | Sheet wt. lbs/3300 ft$^2$ | Caliper | Opacity | Mullen |
|---|---|---|---|---|---|---|---|
| 1 | Frozen[c] | 0 | 40 | 38 | 4.9 | 75 | 26 |
| 2 | None | 0 | 33 | 42 | 4.4 | 67 | 38 |

TABLE IV(A)-continued

PROPERTIES OF SHEETS PREPARED FROM FROZEN AND THAWED PINE PULP[a] PULP BLENDED WITH $TiO_2$[b]

| Sample | Treatment | % Ash | Sheeted at % Solids | Sheet wt. lbs/3300 ft$^2$ | Caliper | Opacity | Mullen |
|---|---|---|---|---|---|---|---|
| 3 | Frozen[c] | 0 | 45 | 33 | 4.7 | 70 | 20 |
| 4 | None | 0 | 43 | 36 | 3.9 | 64 | 38 |
| 5 | Frozen[c] | 0.69 | 10–20 | 42 | — | 80 | — |
| 6 | None | 1.39 | 10–20 | 42 | — | 76 | — |
| 7 | Frozen[c] | 2.5 | 44 | 41 | 4.8 | 80 | 26 |
| 8 | None | 2.3 | 39 | 38 | 3.7 | 73 | 38 |
| 9 | Frozen[c] | 0.69 | 41 | 30 | 3.5 | 66 | 21 |
| 10 | None | 0.69 | 34 | 32 | 3.5 | 63 | 28 |
| 11 | ⅓ Frozen[c] | 1.79 | 41 | 39 | 4.2 | 73 | 27 |
| 12 | ⅔ Frozen[c] | 3.11 | 45 | 41 | 4.5 | 79 | 26 |
| 13 | ⅓ Frozen[c] | 1.21 | 47 | 23 | 3.0 | 59 | 17 |
| 14 | ⅔ Frozen[c] | 2.93 | 44 | 26 | 3.4 | 68 | 17 |

[a]400 CSF, 1.5% consistency.
[b]Titanox ACG.
[c]At 0° F., 20 hours.

TABLE IV(b)

PROPERTIES OF SHEETS PREPARED FROM FROZEN AND THAWED PINE PULP[a] PULP BLENDED WITH $Al_2O_3$

| Sample | Treatment | % Ash | Sheeted at % Solids | Sheet Wt. lbs/3300 ft$^2$ | Caliper | Opacity | Mullen |
|---|---|---|---|---|---|---|---|
| 1 | Frozen[b] | 0 | 40 | 38 | 4.9 | 75 | 26 |
| 2 | None | 0 | 33 | 42 | 4.4 | 67 | 38 |
| 3 | Frozen[b] | 0 | 45 | 33 | 4.7 | 70 | 20 |
| 4 | None | 0 | 43 | 36 | 3.9 | 64 | 38 |
| 5 | Frozen[b] | 1.79 | 44 | 40 | 5.0 | 79 | 21 |
| 6 | None | 0.97 | 40 | 40 | 4.0 | 70 | 36 |
| 7 | Frozen[b] | 3.7 | 49 | 30 | 4.2 | 68 | 17 |
| 8 | None | 3.9 | 42 | 30 | 4.0 | 60 | 22 |

[a]400 CSF, 1.5% consistency.
[b]At 0° F., 20 hours.
[c]Hydral 710 - Aluminum Company of America.
[d]C-31 - Aluminum Company of America.

TABLE IV(C)

PROPERTIES OF SHEETS PREPARED FROM FROZEN AND THAWED PINE PULP[a] PULP BLENDED WITH STARCH[b]

| Sample | Treatment | Sheeted at % Solids | Sheet wt. lbs/3300 ft$^2$ | Caliper | Opacity | Brightness | Mullen |
|---|---|---|---|---|---|---|---|
| 1 | Frozen | 45 | 33 | 4.7 | 70 | 83 | 20 |
| Duplicate | Frozen | 46 | 31 | 3.7 | 69 | 83 | 16 |
| 2 | None | 43 | 36 | 3.9 | 64 | 81 | 38 |
| Duplicate | None | 39 | 35 | 3.5 | 60 | 80 | 33 |
| 3 | Pulp & Starch[b] Frozen | 50 | 36 | 4.8 | 73 | 82 | 30 |
| 4 | Pulp & Starch[b] | 39 | 34 | 3.6 | 60 | 81 | 30 |

[a]400 CSF, 1.5% consistency.
[b]Cooked 5% powdered unmodified starch. Added approximately 10% of pulp solids.

EXAMPLE V

A series of tests were made of the properties of sheets which had been frozen and thawed in wet web form.

A. Frozen and Thawed Bleached Southern Pine Sheets

Tables V(A) to V(E) show properties of frozen and thawed sheets prepared from pine pulp. The effects were measured of using pulp at different freeness values and freezing at several moisture levels between about 60% to 95%.

Sheet weight was maintained in the range of 30–40 lbs/3300 ft. Caliper, opacity, brightness, Mullen, and tear strength of the sheets was determined.

The tables show that freezing increased sheet caliper. When sheets were prepared at 20% solids, the increase in caliper was substantially greater than when sheets were prepared at 40% solids. Examination of Table V(A) indicates that when sheeting was done at 5–10% solids, the relative increase in thickness was even greater. The effect of freeness on caliper was minor.

The effect of freezing was to increase opacity and brightness. With sheeting at a low solids level (5–20%), the opacity increase on freezing may be slightly greater than when sheets were prepared at a higher level (30–40%). The increase in opacity was slightly greater at low freeness (e.g., 200 CSF) than at high freeness (600 CSF or higher).

Mullen strength of unfrozen pine sheets showed a maximum at about 300 CSF. In contrast to this, sheets frozen at 20% consistency showed no peak, and ones frozen at 40% consistency showed only slight evidence of a peak. There was a substantial drop in Mullen as a result of freezing at 20% solids; at 40% solids, the drop was much less.

Unfrozen sheets prepared at 5–10% solids Table V(A) showed a slight, linear increase in tear strength as freeness increased. Frozen sheets, on the other hand, showed a more complex behavior with a maximum tear strength at about 350 CSF. Tear strength of frozen sheets was substantially higher than that of corresponding unfrozen sheets prepared from pulp of the same freeness.

TABLE V(A)

EFFECT OF PULP FREENESS AND AMOUNT OF WATER IN THE WET WEB ON PROPERTIES OF FROZEN AND THAWED SHEETS BLEACHED SOUTHERN PINE

| Sample | Treatment | Freeness CSF, ml | Sheeted at % Solids | Sheet wt. lbs/3300 ft$^2$ | Caliper | Opacity | Mullen | Elmendorf Tear |
|---|---|---|---|---|---|---|---|---|
| 1 | None | 730 | 5-10 | 35.9 | 11 | 77 | 6 | — |
| 2 | Frozen | 730 | 5-10 | 37.5 | 14 | 76 | 2 | 44 |
| 3 | None | 630 | 5-10 | 32.8 | 4 | 64 | 24 | 50 |
| 4 | Frozen | 630 | 5-10 | 32.0 | 9 | 73 | 6 | 69 |
| 5 | None | 420 | 5-10 | 34.4 | 4 | 63 | 35 | 43 |
| 6 | Frozen | 420 | 5-10 | 35.2 | 9 | 80 | 14 | 105 |
| 7 | None | 250 | 5-10 | 35.1 | 4 | 66 | 26 | 35 |
| 8 | Frozen | 250 | 5-10 | 33.6 | 8 | 79 | 15 | 103 |
| 9 | None | 100 | 5-10 | 34.9 | 4 | 61 | 29 | 37 |
| 10 | Frozen | 100 | 5-10 | 36.0 | 8 | 82 | 15 | 82 |

TABLE V(B)

EFFECT OF PULP FREENESS AND AMOUNT OF WATER IN THE WET WEB ON PROPERTIES OF FROZEN AND THAWED SHEETS BLEACHED SOUTHERN PINE

| Sample | Treatment | Freeness CSF, ml | Sheeted at % Solids | Sheet wt. lbs/3300 ft$^2$ | Caliper | Opacity | Brightness | Mullen |
|---|---|---|---|---|---|---|---|---|
| 1 | Frozen | 316 | 36.5 | 29.6 | 4.0 | 68 | 78 | 27 |
| 2 | None | 316 | 36.5 | 29.6 | 3.2 | 54 | 73 | 32 |
| 3 | Frozen | 316 | 35.9 | 35.9 | 3.7 | 70 | 78 | 38 |
| 4 | None | 316 | 35.9 | 35.9 | 3.6 | 57 | 71 | 42 |
| 5 | Frozen | 550 | 36.4 | 35.1 | 5.6 | 76 | 80 | 28 |
| 6 | None | 550 | 36.4 | 35.1 | 4.5 | 65 | 76 | 29 |
| 7 | Frozen | 550 | 39.8 | 30.4 | 4.7 | 70 | 79 | 23 |
| 8 | None | 550 | 39.8 | 30.4 | 3.8 | 62 | 75 | 28 |
| 9 | None | 400 | 43 | 36 | 3.9 | 64 | 81 | 38 |
| 10 | Frozen | 400 | 43 | 36 | 4.0 | 69 | 83 | 21 |

TABLE V(C)

EFFECT OF PULP FREENESS AND AMOUNT OF WATER IN THE WET WEB ON PROPERTIES OF FROZEN AND THAWED SHEETS BLEACHED SOUTHERN PINE

| Sample | Treatment | Freeness CSF, ml | Sheeted at % Solids | Sheet wt. lbs/3300 ft$^2$ | Caliper | Opacity | Mullen |
|---|---|---|---|---|---|---|---|
| 1 | Frozen | 540 | 28 | 32.6 | 5.8 | 74 | 11 |
| 2 | None | 540 | 28 | 32.6 | 4.5 | 66 | 23 |
| 3 | Frozen | 270 | 20 | 31.7 | 5.8 | 76 | 16 |
| 4 | None | 270 | 20 | 31.7 | 3.9 | 63 | 27 |
| 5 | Frozen | 190 | 22 | 29.5 | 5.1 | 75 | 18 |
| 6 | None | 190 | 22 | 29.5 | 3.4 | 62 | 26 |
| 7 | Frozen | 540 | 41 | 32.3 | 4.1 | 70 | 22 |
| 8 | None | 540 | 41 | 32.3 | 3.5 | 62 | 25 |
| 9 | Frozen | 270 | 36 | 30.8 | 3.4 | 68 | 26 |
| 10 | None | 270 | 36 | 30.8 | 3.0 | 57 | 31 |
| 11 | Frozen | 190 | 41 | 29.9 | 3.5 | 66 | 25 |
| 12 | None | 190 | 41 | 29.9 | 2.7 | 55 | 26 |

TABLE V(D)

EFFECT OF AMOUNT OF WATER IN THE WET WEB ON PROPERTIES OF FROZEN AND THAWED SHEETS 360 CSF BLEACHED SOUTHERN PINE

| Sample | Treatment | Sheeted at % Solids | Sheet wt. lbs/3300 ft$^2$ | Caliper | Opacity | Mullen |
|---|---|---|---|---|---|---|
| 1 | Frozen | 9.4 | 32.2 | 8.0 | 75 | 13 |
| 2 | None | 9.4 | 32.6 | 3.8 | 67 | 21 |
| 3 | Frozen | 20.7 | 31.5 | 5.8 | 75 | 17 |
| 4 | None | 20.7 | 30.3 | 3.8 | 63 | 30 |
| 5 | Frozen | 33.8 | 33.1 | 4.0 | 66 | 25 |
| 6 | None | 33.8 | 34.0 | 3.0 | 56 | 29 |
| 7 | Frozen | 53.0 | 34.3 | 3.3 | 62 | 31 |
| 8 | None | 53.0 | 33.1 | 2.8 | 50 | 26 |

TABLE V(E)

EFFECT OF AMOUNT OF WATER IN THE WET WEB ON PROPERTIES OF FROZEN AND THAWED SHEETS 400 CSF BLEACHED SOUTHERN PINE

| Sample | Treatment | Sheeted at % Solids | Sheet wt. lbs/3300 ft$^2$ | Caliper | Opacity | Mullen |
|---|---|---|---|---|---|---|
| 1 | Frozen | 16.6 | 28.8 | 6.5 | 74 | 12 |
| 2 | None | 16.6 | 28.8 | 6.0 | 63 | 18 |

TABLE V(E)-continued

EFFECT OF AMOUNT OF WATER IN THE WET WEB ON PROPERTIES OF FROZEN AND THAWED SHEETS 400 CSF BLEACHED SOUTHERN PINE

| Sample | Treatment | Sheeted at % Solids | Sheet wt. lbs/3300 $ft^2$ | Caliper | Opacity | Mullen |
|---|---|---|---|---|---|---|
| 3 | Frozen | 26.2 | 29.5 | 5.4 | 74 | 16 |
| 4 | None | 26.2 | 29.5 | 4.0 | 63 | 27 |
| 5 | Frozen | 33.4 | 30.4 | 4.8 | 72 | 19 |
| 6 | None | 33.4 | 30.4 | 3.9 | 60 | 27 |
| 7 | Frozen | 35.3 | 31.0 | 4.2 | 71 | 23 |
| 8 | None | 35.3 | 31.0 | 3.7 | 60 | 31 |
| 9 | Frozen | 40.0 | 32.6 | 4.0 | 68 | 26 |
| 10 | None | 40.0 | 32.6 | 3.2 | 57 | 31 |

Summarizing the examples, opacity is raised by as much as 13 points or more, brightness raised 2 to 5 points, and the bulk of the sheet 10% to 100%.

The morphology of the novel fibers of the instant invention has been viewed under electron microscope and it has been noted that the instant fibers differ from all other known wood fibers in that the microfibrils which are normally consolidated into the fiber on drying extend from the fiber as quills on a porcupine and the volume of the fibers is somewhat smaller in cross-section. The higher the degree of hydration of the cellulose fiber prior to treatment by the instant process, the more pronounced the effects on the physical and optical properties of the substrates made from these cellulose fibers.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. The process of making a wood pulp fiber product selected from a wood pulp fiber or a wood pulp fiber web having a lower specific volume for a given surface area than coventionally prepared cellulosic wood pulp fibers or webs comprising utilizing a fiber or a web made from a fiber hydrated to a freeness of about 0 to 650 CSF, freezing the wood pulp fiber while in the form of an aqueous slurry or web having a fiber solids content of about 3 to 60 percent solids by weight to a fiber temperature of at least −5° C. or below, and thawing the aqueous slurry or web, said freezing and thawing occuring without the presence of chemicals reacting with the wood pulp fibers.

2. The process of claim 1 wherein the wood pulp fiber is originally slush or dry pulp fiber selected from hardwood, softwood or combinations thereof, which fiber is prepared by Kraft processing or sulfite processing and may be bleached or unbleached.

3. The process of claim 1 or 2 wherein the freeness is about 350 to 550 CSF for fine paper and 0 to 50 CSF for glassive-type paper, the fiber solids content in the slurry is about 35 to 40 percent, and the fiber is frozen to a temperature of about −5° C. to −12° C.

4. The process of claim 1 or 2 including adding strength improving agents, optical property enhancing agents, or mixtures thereof to the aqueous slurry, said agents being added in amounts sufficient to give improved strength, or enhanced optical properties, or both.

* * * * *